US009856680B2

(12) United States Patent
Bendel et al.

(10) Patent No.: US 9,856,680 B2
(45) Date of Patent: Jan. 2, 2018

(54) METHOD FOR PRODUCING MOTOR VEHICLE LOCKS WITH A TWISTED LOCKING PART EDGE

(71) Applicant: Kiekert Aktiengesellschaft, Heiligenhaus (DE)

(72) Inventors: Thorsten Bendel, Oberhausen (DE); Werner Pohle, Dortmund (DE); Thomas Waldmann, Mulheim Ruhr (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 0 days.

(21) Appl. No.: 14/649,937

(22) PCT Filed: Dec. 11, 2013

(86) PCT No.: PCT/DE2013/000769
§ 371 (c)(1),
(2) Date: Jul. 13, 2015

(87) PCT Pub. No.: WO2014/090214
PCT Pub. Date: Jun. 19, 2014

(65) Prior Publication Data

US 2015/0308166 A1 Oct. 29, 2015

(30) Foreign Application Priority Data

Dec. 12, 2012 (DE) ..... 10 2012 024 379

(51) Int. Cl.
*E05C 3/06* (2006.01)
*E05B 85/24* (2014.01)
(Continued)

(52) U.S. Cl.
CPC ..... *E05B 85/243* (2013.01); *E05B 77/36* (2013.01); *E05B 79/10* (2013.01); *E05B 85/26* (2013.01); *B21D 28/16* (2013.01); *B21D 53/38* (2013.01)

(58) Field of Classification Search
CPC ..... E05B 85/243; E05B 77/36; E05B 79/10; E05B 85/26; B21D 28/16; B21D 53/38
(Continued)

(56) References Cited

U.S. PATENT DOCUMENTS 4,783,103 A * 11/1988 Schlegel ..... E05B 85/26 292/216
6,749,234 B2 * 6/2004 Bruce ..... E05B 85/26 292/216
(Continued)

FOREIGN PATENT DOCUMENTS

DE 102007060626 A1 6/2009
DE 102010011716 A1 6/2011
(Continued)

OTHER PUBLICATIONS

Machine translation of DE102007060626A1 by Lexis Nexis Total Patent dated Jul. 9, 2015.
(Continued)

*Primary Examiner* — Kristina R Fulton
*Assistant Examiner* — Faria F Ahmad
(74) *Attorney, Agent, or Firm* — Woodard, Emhardt, Moriarty, McNett & Henry LLP

(57) ABSTRACT

In order to minimize the sliding friction between the locking parts that is, between the pawl and the rotary latch of a motor vehicle lock, it is advantageous if, during the production process, the different latch surfaces of both locking parts are provided with a stamping contour having straight grooves and with a stamping contour characterized in that the
(Continued)

provided grooves are oblique. Said oblique grooves of the latch surface on the pawl are placed in the position indicated in figure such that the entire pawl is twisted about the longitudinal axis thereof. Also, at least two overlapping points are provided between the straight grooves and the oblique grooves such that both of the locking parts come into mutual contact reducing the friction.

12 Claims, 3 Drawing Sheets

(51) Int. Cl.

| | |
|---|---|
| ***E05B 77/36*** | (2014.01) |
| ***E05B 85/26*** | (2014.01) |
| ***E05B 79/10*** | (2014.01) |
| *E05C 3/04* | (2006.01) |
| *E05C 3/16* | (2006.01) |
| *B21D 53/38* | (2006.01) |
| *B21D 28/16* | (2006.01) |

(58) Field of Classification Search
USPC ..... 292/195, 201, 210, 216, DIG. 23
See application file for complete search history.

(56) References Cited

U.S. PATENT DOCUMENTS

| | | | | |
|---|---|---|---|---|
| 6,789,825 | B2 * | 9/2004 | Kalargeros | E05B 85/26 292/201 |
| 7,467,816 | B2 * | 12/2008 | Nakagawa | E05B 85/26 292/216 |
| 7,475,923 | B2 * | 1/2009 | Ottino | E05B 85/26 292/216 |
| 8,528,950 | B2 * | 9/2013 | Organek | E05B 17/007 292/216 |
| 2002/0000724 | A1 * | 1/2002 | Kalargeros | E05B 85/26 292/195 |
| 2006/0279090 | A1 * | 12/2006 | Ottino | E05B 85/26 292/216 |
| 2011/0319524 | A1 * | 12/2011 | Leibler | B29C 73/02 523/446 |
| 2015/0315828 | A1 * | 11/2015 | Bendel | E05B 77/40 292/195 |
| 2015/0315829 | A1 * | 11/2015 | Bendel | E05B 85/26 292/195 |
| 2015/0330119 | A1 * | 11/2015 | Bendel | E05B 85/26 292/195 |

FOREIGN PATENT DOCUMENTS

| | | | |
|---|---|---|---|
| DE | 102010009141 | A1 | 8/2011 |
| DE | 102010023919 | A1 | 12/2011 |

OTHER PUBLICATIONS

Machine translation of DE102010009141A1 by Lexis Nexis Total Patent dated Jul. 9, 2015.
Machine translation of DE102010011716A1 by Lexis Nexis Total Patent dated Jul. 9, 2015.
Machine translation of DE102010023919A1 by Lexis Nexis Total Patent dated Jul. 9, 2015.

* cited by examiner

METHOD FOR PRODUCING MOTOR VEHICLE LOCKS WITH A TWISTED LOCKING PART EDGE

CROSS-REFERENCE TO RELATED APPLICATIONS

This application is the U.S. national stage application of International Patent Application No. PCT/DE2013/000769, filed Dec. 11, 2013, which claims priority of German Application No. 10 2012 024 379.0, filed Dec. 12, 2012, which are both hereby incorporated by reference.

BACKGROUND

The invention relates to a method for producing the locking parts catch and pawl of a motor vehicle door lock, in which the catch and pawl have been stamped resulting in vertical or near vertical edges with corresponding ratchet surfaces on the pawl and catch and which have then been covered by a coating except for the ratchet surface. The invention also refers to a motor vehicle door latch with a catch and a pawl locking the catch when the motor vehicle door latch is closed, with both locking parts containing corresponding ratchet surfaces on the vertical edges created during stamping and a coating not covering the ratchet surfaces.

In general, so-called creaking noises than can be generated during driving of a vehicle between the hanger arms and the catch, are reduced by either applying a surface structure reducing the sliding friction to the hanger arms or also the catch in the area in which these come into contact with each other. In the prior art disclosed in DE 10 2010 009 141 A1 grooves or respective webs are applied to the hanger arms in the contact area that run obliquely to the longitudinal axis of the hanger arm. These aim to reduce said creaking. These solutions do, however, not take into consideration that during the actual production of the hanger arms and, in particular, of the locking parts, catch and pawl, a surface favoring creaking exists on the corresponding ratchet surface. During stamping channels and grooves are created on the edge surfaces which can engage with each other in particular when the pawl is pivoted away.

SUMMARY

The invention thus has the task of suggesting a motor vehicle door latch largely avoiding any noise generated during opening and closing of the motor vehicle door latch on the ratchet surface of the catch and pawl when moved.

The invention solves this task in the way that after stamping of the locking parts, one of the parts is twisted by a specified angle, which otherwise would engage with the stamped contour of the other locking part by means of the grooves arranged parallel to each other.

In a not corresponding production process, the stamping contours created by stamping and containing grooves would come into contact with the stamping contour of the facing locking part in such a way that they would engage with each other and would adversely affect movement of the pawl on the catch or would cause a jerky movement resulting in the described undesirable noises. The invention remedies this by preventing the stamping contours containing said grooves from engaging with each other as the stamped contour of the twisted locking part only matches on some points with the twisted locking part where it thus makes contact. The sliding friction that has to be overcome is thus considerably reduced and, in particular, any engaging of the stamped grooves is reliably prevented. The invention thus not only minimizes the sliding friction but also prevents both locking parts getting caught in each other, making the operation of such a motor vehicle door latch considerably safer.

In an appropriate embodiment of the invention, the pawl and its stamping contour containing straight grooves is twisted at a predefined angle, so that in contrast to the straight grooves of the other locking part the grooves of the stamped pawl contour are oblique. The pawl is a component which, due to its shape is easily twisted so that in contrast to the other locking part, a stamping contour containing oblique grooves is then created.

In order to optimize the operation of the motor vehicle door lock, the invention provides for the locking part to be twisted at an angle resulting in at least two overlapping points of straight and oblique grooves. In two of such overlapping points, or contact points of the two locking parts in contact with each other, an unwanted engaging of the stamped grooves is thus effectively prevented and it is ensured that both locking parts, exerting equal friction on each other, can be pivoted apart.

In order to achieve the at least two overlapping points, it is advantageous for the twisting angle to be set to 5-15° taking into consideration the thickness of the locking parts and the distance of the grooves. Such twisting can be easily implemented even when considering that the pawl is made, for instance, of a type of metal. Such an only slightly twisted component or locking part can then be used in the motor vehicle door latch without the need for further modifications and changes.

In another appropriate embodiment of the invention, both locking parts, i.e. catch and pawl are twisted in such a way that the grooves of the facing ratchet surfaces of the locking parts contain respective overlapping points or contact points, preventing any adverse engaging of the stamped grooves. If both locking parts are twisted accordingly, the amount of twisting in both parts is less than if, for instance only the pawl would be twisted. Twisting of the pawl is still significantly easier than twisting of the catch, even if the catch only has to be twisted in a small area, i.e. not the entire catch has to be twisted.

For implementation of the method it is advantageous for a locking part to contain a ratchet surface with a stamping contour, whose normally straight grooves are arranged diagonally by twisting of the locking part in contrast to the straight grooves of the other locking part or that act as oblique grooves. Using such a designed locking part, it is possible to prevent said engagement of the stamped grooves when the pawl is pivoted along the catch for opening of the motor vehicle door latch or initiating the opening process. One locking part remains unchanged, whilst the second locking part, and preferably the pawl, is stamped into a format in which the ratchet surface contains oblique grooves, able to advantageously cooperate with the straight grooves of the other locking parts.

Particularly advantageously, the oblique grooves are formed in the twisted part of the pawl. The pawl is essentially a rectangular piece of sheet metal that can be twisted as a whole or also in parts thereof in order to produce the oblique grooves. It is therefore suggested to provide the pawl with the oblique grooves whilst the catch as such remains unchanged, i.e. retains its straight grooves. Together with the ratchet surface of the pawl also the front part of the pawl is twisted which is, however, of no relevance for guiding and supporting the pawl on the catch due to the thickness of the pawl.

It has already been pointed out that the pawl only has to be twisted by a slight amount or angle in order to achieve the desired or extremely advantageous oblique grooves. It is, however, also possible to twist both locking parts, i.e. the pawl and the catch, in opposing directions by a respectively smaller angle. This also achieves that the stamped grooves of both locking parts do not impede each other but allow unimpeded gliding of the pawl on the catch.

Apart from the option of twisting both locking parts, another option is for the catch to be twisted in the area facing the pawl to provide respective overlapping points on the ratchet surfaces. Even if the catch as such cannot or can only be twisted with respective effort, the option of restricting this twisting to a certain partial section of the catch exists.

Even in the event that, for instance, the pawl can only be twisted in a partial section, it is particularly expedient for one of the locking parts, preferably the pawl to be twisted around its longitudinal axis. This means that the entire pawl as such is twisted by the intended amount even if only the section of the pawl containing the ratchet surface does actually have to be twisted to produce oblique grooves.

The particular advantage of the invention is that with very little additional manufacturing effort a motor vehicle door latch can be produced in which the pawl and catch in the latching area, i.e. in the area in which they both rest against each other, are designed in such a way that previously generated noises are significantly reduced. This is achieved by reducing the sliding friction, i.e. by the created overlapping points in form of the straight grooves and oblique grooves. The overlapping points also advantageously prevent any engagement of the originally straight grooves. As it is a near square component or sheet metal part, the pawl is particularly suitable for twisting as a locking part. Also, only slight twisting is required to achieve the oblique grooves. All in all, this makes the operation of such a motor vehicle door latch easier and more reliable and significantly reduces the generated noise.

Further details and advantages of the object of the invention are provided in the below description of the associated drawing, showing a preferred embodiment with all required details and individual components. In which:

DETAILED DESCRIPTION OF THE DRAWINGS

Figure 1:
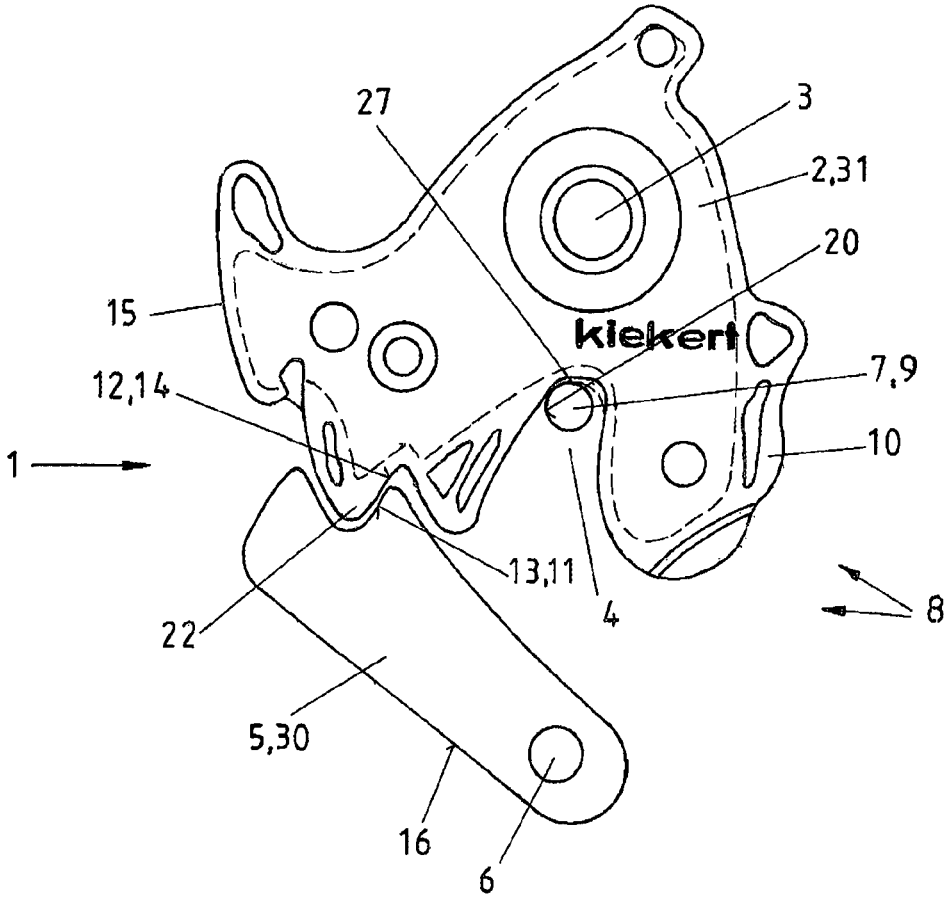
FIG. 1 shows a top view of a motor vehicle door latch in a closed state.

FIG. 1 shows a top view of a motor vehicle door latch 1, in which the catch 2 moving around axis 3 contains the hanger arm 9 of the latch bracket 7. This shows the closing state of a respective motor vehicle door latch 1; the catch 2 is secured by pawl 5 pivotable around pawl axis 6, i.e. the motor vehicle door latch 1 can only be opened again once the pawl 5 has been pivoted away, which can be achieved by actuation of the handle of the motor vehicle door—not shown in the drawing. By means of the seat 4, the hanger arm 9 is moved into the lowest point 27 on the catch 2 thus ensuring the closed condition of also the vehicle door—not shown, with the locking parts 30, 31, i.e. the pawl 5 and the catch 2 being part of the motor vehicle door, whilst the latch bracket 7 with the hanger arms 9 is secured to the car body of the motor vehicle.

The locking parts 30, 31 of the locking mechanism 8 are produced from sheet metal in preferably multiple stamping operations and at the ratchet surfaces 12, 13 not covered by the coating 10, the surface of both locking parts 30, 31 is initially characterized by a stamping contour 14. In the area of the ratchet surface 13 this surface structure has, however been changed as the grooves 18, 19 forming the stamping contour 11 are oblique as a result of the twisting of the component and, in particular pawl 5, and are shown as oblique grooves 18', 19' in FIG. 3. This stamping contour 11 produces a considerably better sliding friction between the locking parts 30, 31, i.e. the pawl 5 on the catch 2, so that the unwanted noises can no longer be generated.

It is not particularly highlighted in the figure that the edges 15, 16 of the catch 2 and pawl 5 contain a plastic coating 10. The edges 15, 16 are thus covered by such a coating, whilst only in the area of the ratchet surfaces 12, 13 and also on the contact surface 20 this coating is not applied, allowing the special surface structure, as shown in the below figures, to become effective. The surface structure ensures that the noise and sliding friction are reduced to a minimum, with both cooperating.

Figure 2:
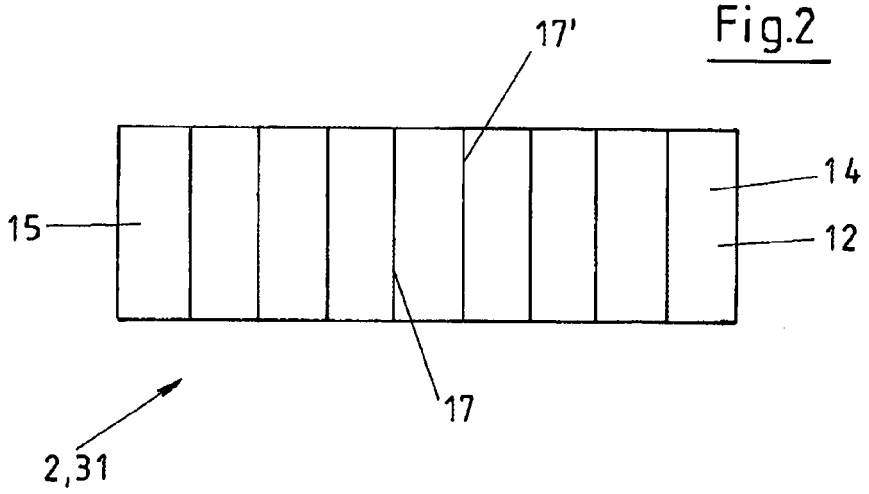
FIG. 2 shows an enlargement of the edge profile of a catch in the area of its ratchet surface.

FIG. 2 shows the area of the ratchet surface 12 on the catch 2 that has to correspond with the ratchet surface 13 on the pawl 5 during opening and closing of the motor vehicle door latch 1. This means that during opening and closing of the motor vehicle door latch 1, the two locking parts 30, 31 rub against each other in the area of the ratchet surfaces 12, 13 or even on top of each other at the edges 15, 16, which can, in particular in case of the straight grooves 17, shown in FIG. 2, cause problems, when the ratchet surface 13 on the pawl 5 is the same, i.e. contains straight grooves. As apparent from a comparison between FIGS. 2 and 3 this has, however, been avoided by the latching contour of the ratchet surface 13 being oblique, as a result of the entire component, i.e. the pawl 5 being twisted by a certain angle.

Figure 3:
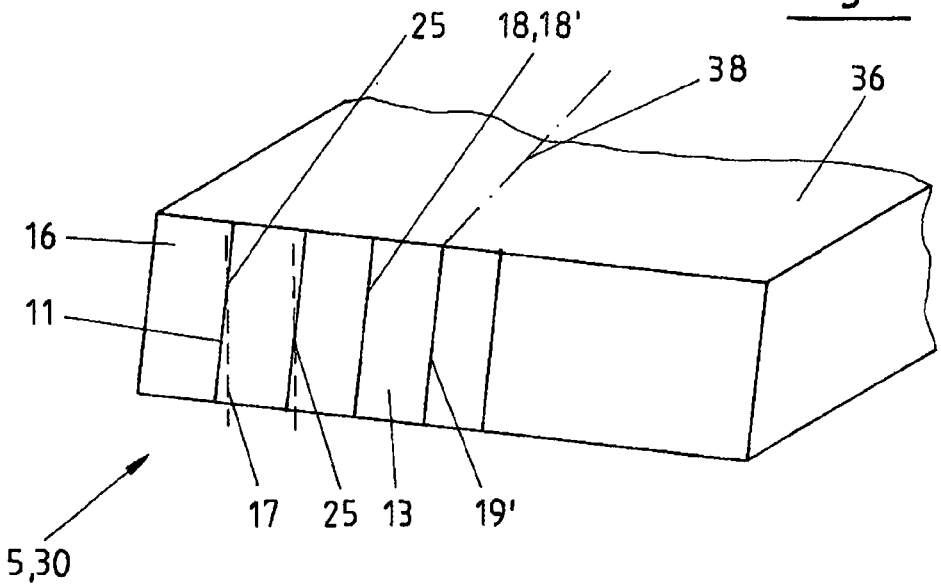
FIG. 3 shows an enlargement of the ratchet surface of the pawl in the twisted state and FIG. 4 a perspective view of the catch with the particular edge formation.

FIG. 3 shows that the end state has not been reached as yet, i.e. the pawl 5 has to be twisted further in order to ensure that at least two overlapping points 25 have to be provided. The, in this case, oblique grooves 18', 19', in particular in the area of the main ratchet position 22, reduce the sliding friction and the produced friction noise, as the oblique grooves 18', 19', as apparent from FIG. 3, only contain a few overlapping points 25. Here, too, it can be assumed that the oblique arrangement caused by the twisting of the pawl 5 around its longitudinal axis 38 is around 5-15°, in order to achieve the desired two overlapping points in each case. It is important that said overlapping points 25 are provided in order not to adversely affect the movement of the pawl 5 on the catch 2, so that the movement is even, thus reducing the sliding friction and the noise to such an extent that they are no longer causing a problem. Numeral 36 refers to the twisted part of the pawl 5, although generally, due to the overall design of the pawl 5, it has been found to be advantageous for the entire component to be twisted in such a way that the ratchet surface 13 contains the oblique grooves 18', 19'.

A comparison of FIG. 2 and FIG. 3 shows that when the ratchet surface 12 meets the ratchet surface 13, i.e. the facing area 37, the grooves 17, 18 and 19 can no longer engage.

Figure 4:
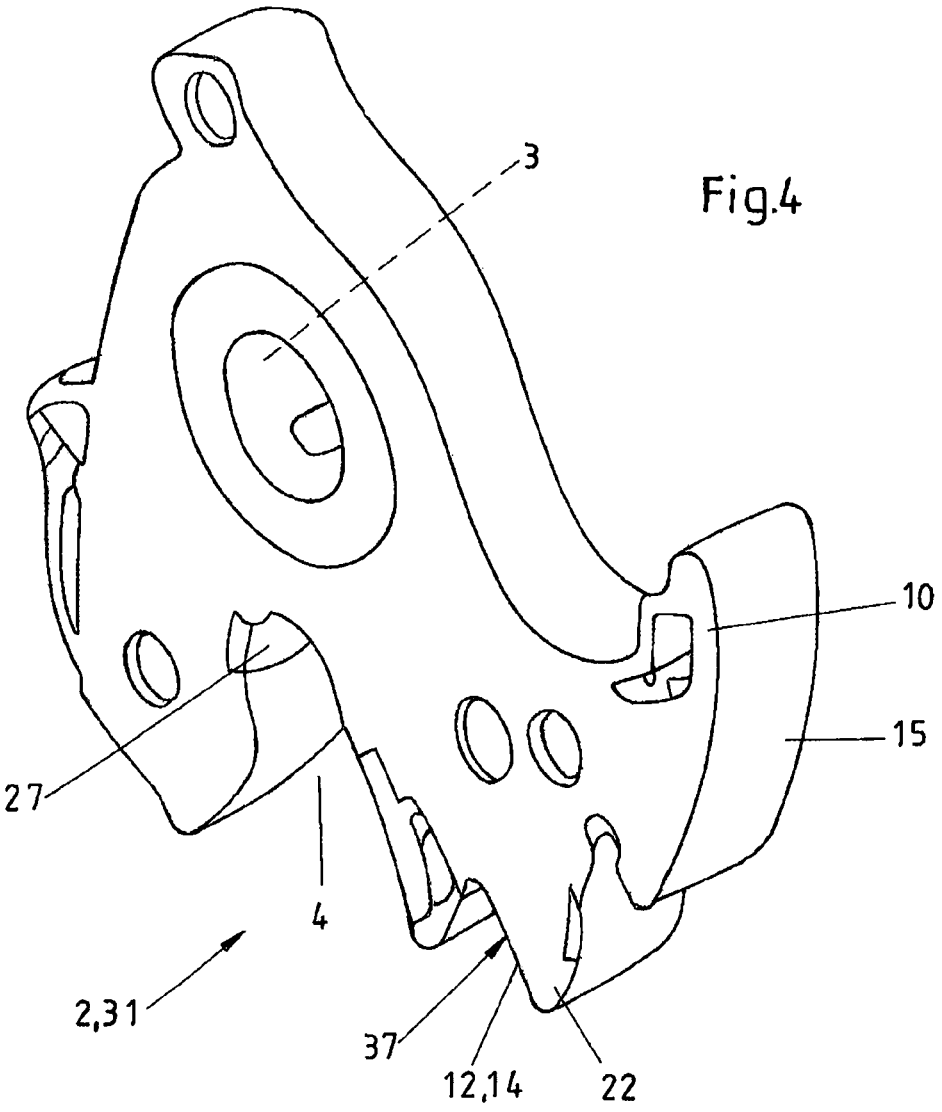

FIG. 4 shows a perspective view of the catch 2 that can be pivoted around axis 3—not shown in the drawing. When pivoting the catch 2, the hanger arm 9, not shown in FIG. 4, is inserted in the seat 4 or released therefrom, so that the motor vehicle door can then be opened or evenly closed and is then locked in the closed position by the pawl 5. FIG. 4 shows that the stamping of the catch 2 produces a clearly visible edge 15 whose surface, as explained above, is characterized by the stamping contour 14 on the ratchet surface 12. This stamping contour 14 is only indicated in FIG. 4. The ratchet surface 12 indicates the main ratchet position 22, i.e. the position in which the pawl 5 prevents the catch 2 for pivoting back in the closed position. In this case, the ratchet surface 13 of the pawl 5 rests, as already explained, on the latching surface 12 of the catch 2 and both parts can move on top of each other with less friction, without unwanted noises being generated, as the straight grooves 17 of the catch 2 and the oblique grooves 18', 19' of the pawl 5 cannot engage or latch with each other.

It is apparent that at the lowest point 27 of the seat 4 it contains a surface deviating from the other surface of the edge 15, which is, in particular, achieved by the fact that this area is not covered by a coating 10 and that a separate part has been inserted at this point to positively affect the sliding effect of the catch 2 at the hanger arm 9.

All aforementioned characteristics, including those only shown in the drawings, are separately or in combination essential parts of the invention.

The invention claimed is:

1. Method for producing a first locking part of a motor vehicle door lock, namely, a catch and a second locking part of the motor vehicle door lock, namely, a pawl, wherein:

the catch and the pawl are stamped, said stamping generates a stamped contour that includes grooves extending across a thickness of both the catch and the pawl along an axis;

after said stamping, one of the locking parts is deformed by twisting by a specified angle in an area which is engaged by a stamping contour of the other locking part such that the grooves on the twisted locking part in the area are not aligned with either the axis or the grooves on the other locking part that engage the area; and the catch and the pawl are coated except for latching surfaces.

2. Method according to claim 1, wherein the grooves in the stamped contour of the catch and the pawl include straight grooves, the pawl is twisted by a specified first angle, so that the twisted grooves of the pawl are oblique relative to the straight grooves in the catch.

3. Method according to claim 2, wherein the catch is twisted by a second angle, resulting in at least two overlapping points of straight and oblique grooves.

4. Method according to claim 2, wherein the first angle of twisting is set to 5-15° depending on the thickness of the pawl and the distance of the grooves.

5. Method according to claim 1, wherein the catch and pawl are twisted to such an extent that the grooves of the other facing latching surface of the catch and the pawl contain respective overlapping points or contact points.

6. Motor vehicle door latch with a first locking part, namely, a catch and a second locking part, namely, a pawl locking the catch when the motor vehicle door is closed, wherein both the catch and the pawl contain corresponding ratchet surfaces on vertical edges created during stamping, the ratchet surfaces including straight grooves extending along an axis and a coating except for on the ratchet surfaces, one of the locking parts is deformed by twisting the one locking part after stamping so that the ratchet surface on the one locking part includes a stamping contour whose straight grooves are obliquely arranged in relation to both the axis and the straight grooves of the other locking part as a result of twisting of the one locking part.

7. Motor vehicle door latch according to claim 6, wherein the oblique grooves are formed on the twisted part of the pawl.

8. Motor vehicle door latch according to claim 6, wherein both the catch and the pawl are twisted in opposite directions by a respective smaller angle.

9. Motor vehicle door latch according to claim 6, wherein the catch is twisted in the area opposite to the pawl creating respective overlapping points on the ratchet surfaces.

10. Motor vehicle door latch according to claim 6, wherein the pawl or the catch is twisted around its longitudinal axis.

11. Method according to claim 3, wherein the angle of twisting is set to 5-15° depending on the thickness of the pawl and the distance of the grooves.

12. Method according to claim 2, wherein the catch and pawl are twisted to such an extent that the grooves of the other facing latching surface of the catch and the pawl contain respective overlapping points or contact points.

* * * * *